US010660400B2

(12) United States Patent
Baucom et al.

(10) Patent No.: US 10,660,400 B2
(45) Date of Patent: May 26, 2020

(54) SOLE STRUCTURE FOR AN ARTICLE OF FOOTWEAR HAVING GROOVES AND A FLEX CONTROL INSERT WITH RIBS

(71) Applicant: NIKE, Inc., Beaverton, OR (US)

(72) Inventors: Jim Baucom, Portland, OR (US); Bryan N. Farris, North Plains, OR (US); Alison Sheets-Singer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 272 days.

(21) Appl. No.: 15/676,127

(22) Filed: Aug. 14, 2017

(65) Prior Publication Data

US 2018/0055143 A1 Mar. 1, 2018

Related U.S. Application Data

(60) Provisional application No. 62/379,421, filed on Aug. 25, 2016.

(51) Int. Cl.
*A43B 13/14* (2006.01)
*A43B 13/18* (2006.01)
(Continued)

(52) U.S. Cl.
CPC ..... *A43B 13/141* (2013.01); *A43B 7/1425* (2013.01); *A43B 13/125* (2013.01);
(Continued)

(58) Field of Classification Search
CPC ... A43B 13/141; A43B 13/125; A43B 13/181; A43B 13/183; A43B 13/223;
(Continued)

(56) References Cited

U.S. PATENT DOCUMENTS 767,120 A * 8/1904 Pratt ..... A43B 13/12 152/211
981,154 A * 1/1911 Austin ..... A43B 9/06 36/17 R
(Continued)

FOREIGN PATENT DOCUMENTS

DE 102012104264 A1 11/2013
EP 1483981 A1 12/2004
(Continued)

*Primary Examiner* — Heather N Mangine
(74) *Attorney, Agent, or Firm* — Quinn IP Law

(57) ABSTRACT

A sole structure includes a sole plate having a foot-facing surface with a forefoot portion, and a ground-facing surface opposite from the foot-facing surface. The sole plate includes a plurality of grooves extending transversely relative to a longitudinal axis of the sole plate, in the forefoot region of the foot-facing surface. A flex control insert includes an upper surface, and a lower surface opposite the upper surface. The flex control insert includes a plurality of ribs protruding from the lower surface of the flex control insert, which extend transversely relative to the longitudinal axis of the sole plate. Each one of ribs is disposed within a different respective one of the grooves. The ribs are strong in compression, and maintain their volume to resist compression by the grooves as the sole plate flexes in a longitudinal direction to increase the bending stiffness of the sole plate.

15 Claims, 4 Drawing Sheets

(51) Int. Cl.
*A43B 7/14* (2006.01)
*A43B 13/22* (2006.01)
*A43B 13/12* (2006.01)

(52) U.S. Cl.
CPC ..... *A43B 13/181* (2013.01); *A43B 13/183* (2013.01); *A43B 13/223* (2013.01)

(58) Field of Classification Search
CPC ..... A43B 13/12; A43B 13/127; A43B 13/16; A43B 13/185; A43B 13/41; A43B 13/42; A43B 7/1425; A43B 7/185; A43B 17/003; A43B 17/006; A43B 17/02
USPC ..... 36/102, 107, 25 R, 28, 30 R, 30 A, 31
See application file for complete search history.

(56) References Cited

U.S. PATENT DOCUMENTS 984,806 A * 2/1911 Foster ..... A43B 13/12 36/59 B
1,607,896 A * 11/1926 Kelly ..... A43B 13/141 36/22 R
2,124,819 A * 7/1938 Halloran ..... A43B 13/42 36/30 A
2,201,300 A * 5/1940 Prue ..... A43B 9/00 12/142 F
2,318,926 A * 5/1943 Daniels ..... A43B 13/141 12/146 BP
2,379,139 A * 6/1945 Flink ..... A43B 13/141 12/41.05
2,640,283 A * 6/1953 McCord ..... A43B 5/00 36/130
2,809,450 A * 10/1957 Stritter ..... A43B 9/125 36/44
3,087,262 A * 4/1963 Russell ..... A43B 13/181 36/28
3,834,046 A * 9/1974 Fowler ..... A43B 13/181 36/28
4,044,479 A * 8/1977 Brutting ..... A43B 13/14 36/32 R
4,229,889 A * 10/1980 Petrosky ..... A43B 13/203 36/28
4,494,322 A * 1/1985 Klagmann ..... A43B 13/186 36/28
4,498,251 A 2/1985 Shin
4,507,879 A * 4/1985 Dassler ..... A43B 5/02 36/102
4,550,510 A 11/1985 Stubblefield
4,557,060 A * 12/1985 Kawashima ..... A43B 5/00 36/30 R
4,561,195 A * 12/1985 Onoda ..... A43B 5/00 36/28
4,615,126 A * 10/1986 Mathews ..... A43B 5/06 36/102
4,633,877 A * 1/1987 Pendergast ..... A43B 7/14 36/140
4,638,577 A * 1/1987 Riggs ..... A43B 13/185 36/114
4,658,514 A * 4/1987 Shin ..... A43B 5/06 36/30 R
4,667,423 A * 5/1987 Autry ..... A43B 13/12 36/102
4,779,361 A * 10/1988 Kinsaul ..... A43B 13/141 36/102
4,852,274 A * 8/1989 Wilson ..... A43B 13/20 36/29
4,930,231 A * 6/1990 Liu ..... A43B 13/02 36/30 A
5,077,915 A * 1/1992 Gross ..... A43B 13/12 36/114
5,163,237 A * 11/1992 Rosen ..... A43B 3/26 36/140
5,224,277 A * 7/1993 Sang Do ..... A43B 7/081 36/27
5,365,678 A * 11/1994 Shibata ..... A43B 13/20 36/141
5,367,791 A * 11/1994 Gross ..... A43B 13/181 36/25 R
5,572,805 A * 11/1996 Giese ..... A43B 13/12 36/103
5,619,809 A * 4/1997 Sessa ..... A43B 7/06 36/28
5,758,435 A * 6/1998 Miyata ..... A43B 1/0009 36/132
5,768,803 A * 6/1998 Levy ..... A43B 7/1425 36/140
6,082,023 A * 7/2000 Dalton ..... A43B 13/187 36/103
6,092,307 A * 7/2000 Singer ..... A43B 9/00 36/12
6,119,370 A * 9/2000 Baron ..... A43B 7/14 36/141
6,237,255 B1 * 5/2001 Renaudin ..... A43B 3/26 36/102
6,253,466 B1 7/2001 Harmon-Weiss et al.
6,314,664 B1 * 11/2001 Kita ..... A43B 13/12 36/28
6,321,469 B1 * 11/2001 Cretinon ..... A43B 13/10 36/102
6,519,876 B1 * 2/2003 Geer ..... A43B 1/0081 36/102
7,386,945 B2 * 6/2008 Burgess ..... A43B 5/00 36/3 R
7,467,484 B2 * 12/2008 Chang ..... A43B 7/1445 36/103
7,513,065 B2 4/2009 Kita et al.
8,104,197 B2 1/2012 Flannery et al.
8,365,444 B2 2/2013 Youngs
8,656,613 B2 2/2014 Stockbridge et al.
8,973,287 B2 * 3/2015 Shibata ..... A43B 7/144 36/141
2001/0007177 A1 * 7/2001 Brown, Jr. ..... A43B 13/026 36/27
2001/0032400 A1 * 10/2001 Brooks ..... A43B 13/12 36/102
2002/0092202 A1 * 7/2002 Masseron ..... A43B 13/12 36/28
2003/0033730 A1 * 2/2003 Burke ..... A43B 7/142 36/25 R
2003/0056396 A1 * 3/2003 Murray ..... A43B 13/183 36/28
2004/0091675 A1 * 5/2004 Yang ..... A43B 13/181 428/174
2004/0128861 A1 * 7/2004 Durand ..... A43B 3/26 36/97
2004/0237343 A1 * 12/2004 Herman ..... A43B 7/146 36/28
2004/0250446 A1 * 12/2004 Greene ..... A43B 7/08 36/25 R
2005/0039350 A1 * 2/2005 Hung ..... A43B 7/32 36/107
2005/0150134 A1 * 7/2005 Issler ..... A43B 13/141 36/102
2005/0193589 A1 * 9/2005 Bann ..... A43B 13/181 36/28
2005/0257402 A1 * 11/2005 Kobayashi ..... A43B 5/10 36/59 R
2006/0123665 A1 * 6/2006 Covatch ..... A43B 13/141 36/102
2006/0137227 A1 * 6/2006 Kita ..... A43B 13/12 36/102
2006/0185197 A1 * 8/2006 Rhenter ..... A43B 1/0045 36/174
2007/0039208 A1 2/2007 Bove et al.
2007/0169376 A1 7/2007 Hatfield et al.
2007/0277401 A1 * 12/2007 Young-Chul ..... A43B 13/12 36/30 R

(56) References Cited

U.S. PATENT DOCUMENTS

2008/0010863 A1* 1/2008 Auger ..... A43B 13/026 36/107
2008/0022562 A1* 1/2008 Manis ..... A43B 13/26 36/59 R
2008/0086908 A1* 4/2008 Berend ..... A43B 7/28 36/44
2008/0222920 A1* 9/2008 Rovida ..... A43B 5/18 36/100
2008/0229617 A1* 9/2008 Johnson ..... A43B 3/0057 36/102
2008/0307671 A1* 12/2008 Koffler ..... A43B 7/1455 36/28
2009/0056172 A1* 3/2009 Cho ..... A43B 7/081 36/3 B
2009/0241372 A1* 10/2009 Ryu ..... A43B 7/08 36/29
2010/0154258 A1* 6/2010 Scholz ..... A43B 13/141 36/30 R
2010/0186257 A1* 7/2010 Karl ..... A43B 5/12 36/44
2010/0212187 A1* 8/2010 Jones ..... A43B 3/0047 36/44
2010/0218397 A1* 9/2010 Nishiwaki ..... A43B 7/142 36/28
2010/0287795 A1* 11/2010 Van Niekerk ..... B29C 44/0415 36/25 R
2010/0313447 A1* 12/2010 Becker ..... A43B 13/026 36/102
2011/0016749 A1* 1/2011 Callahan ..... A43B 3/0057 36/103
2011/0072685 A1* 3/2011 Gutowsky, Jr. ..... A43B 7/142 36/44
2011/0277346 A1* 11/2011 Peyton ..... A43B 13/20 36/29
2012/0036739 A1* 2/2012 Amos ..... A43B 7/1425 36/103
2012/0055047 A1* 3/2012 Youngs ..... A43B 13/141 36/25 R
2012/0060391 A1* 3/2012 Hong ..... A43B 1/0045 36/31
2012/0180336 A1* 7/2012 Sullivan ..... A43B 7/144 36/31
2012/0210606 A1* 8/2012 Gheorghian ..... A43B 5/06 36/103
2013/0019499 A1* 1/2013 Hsu ..... A43B 17/006 36/44
2013/0031804 A1* 2/2013 Abshire ..... A43B 7/1425 36/103
2014/0075779 A1* 3/2014 Bruce ..... A43B 13/20 36/29
2014/0250720 A1* 9/2014 Miner ..... A43B 13/20 36/29
2014/0250723 A1* 9/2014 Kohatsu ..... A43B 3/26 36/88
2014/0283413 A1* 9/2014 Christensen ..... A43B 3/0057 36/102
2015/0089841 A1 4/2015 Smaldone et al.
2015/0196087 A1* 7/2015 Meschter ..... A43B 13/18 36/25 R
2015/0223564 A1* 8/2015 Peyton ..... A43B 13/122 36/29
2015/0351492 A1* 12/2015 Dombrow ..... A43B 13/122 36/102
2016/0192739 A1* 7/2016 Hoffer ..... A43B 13/122 36/28
2017/0079374 A1 3/2017 Farris et al.
2017/0079375 A1 3/2017 Bunnell et al.
2017/0079376 A1 3/2017 Bunnell et al.
2017/0079378 A1 3/2017 Farris et al.
2017/0127755 A1* 5/2017 Bunnell ..... A43B 13/223
2017/0202304 A1* 7/2017 Ng ..... A43B 13/186
2017/0208897 A1* 7/2017 Mokos ..... A43B 13/141
2017/0318903 A1* 11/2017 Rasmussen ..... A43B 13/187
2017/0340056 A1* 11/2017 Bunnell ..... A43B 3/06
2017/0340058 A1* 11/2017 Madore ..... A43B 5/001
2018/0027922 A1* 2/2018 Orand ..... A43B 13/04
2018/0042338 A1* 2/2018 Orand ..... A43B 13/125
2018/0064208 A1* 3/2018 Hurd ..... B29D 35/122
2018/0327564 A1* 11/2018 Baghdadi ..... C08J 9/122
2018/0343968 A1* 12/2018 James ..... A43B 5/0413

FOREIGN PATENT DOCUMENTS

FR 892219 A 3/1944
FR 2974482 A1 11/2012
WO 2006087737 A1 8/2006
WO 2011005728 A1 1/2011

* cited by examiner

SOLE STRUCTURE FOR AN ARTICLE OF FOOTWEAR HAVING GROOVES AND A FLEX CONTROL INSERT WITH RIBS

CROSS-REFERENCE TO RELATED APPLICATIONS

This application claims the benefit of U.S. Provisional Patent Application Ser. No. 62/379,421 filed on Aug. 25, 2016, the disclosure of which is hereby incorporated by reference.

TECHNICAL FIELD

The present disclosure generally relates to a sole structure for an article of footwear.

BACKGROUND

Footwear typically includes a sole structure configured to be located under a wearer's foot to space the foot away from the ground. Sole structures in athletic footwear are configured to provide desired cushioning, motion control, and resiliency.

DETAILED DESCRIPTION

Figure 1:
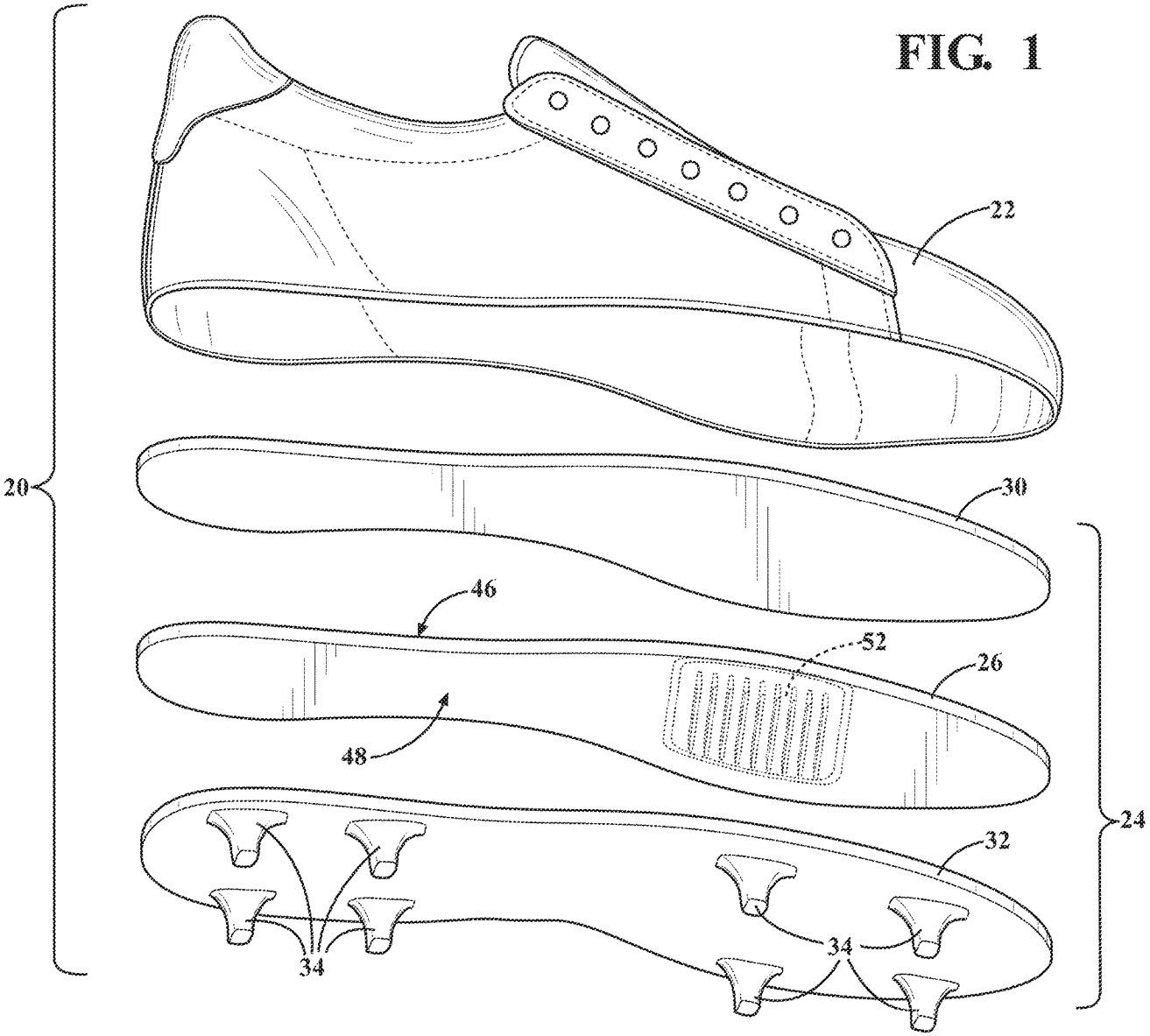
FIG. 1 is a schematic exploded perspective view of an article of footwear having an upper and a sole structure.

A sole structure for an article of footwear includes a sole plate having a longitudinal axis. The sole plate includes a foot-facing surface with a forefoot portion, and a ground-facing surface disposed opposite from the foot-facing surface. The sole plate includes a plurality of grooves, with each groove extending transversely relative to the longitudinal axis of the sole plate, in the forefoot region of the foot-facing surface. The sole structure further includes a flex control insert. The flex control insert includes an upper surface and a lower surface disposed opposite the upper surface. The flex control insert includes a plurality of ribs that protrude outward from the lower surface of the flex control insert. The ribs extend transversely relative to the longitudinal axis of the sole plate. Each one of the plurality of ribs is disposed within a different, respective one of the plurality of grooves.

The flex control insert includes a thickness between the upper surface and the lower surface of the flex control insert. The sole plate includes a recess in the foot-facing surface of the sole plate. The recess in the foot-facing surface has a depth that is substantially equal to the thickness of the flex control insert, so that the upper surface of the flex control insert is substantially level with the foot-facing surface of the sole plate.

A cross section of each of the plurality of grooves along the longitudinal axis of the sole plate defines a groove cross sectional shape. A cross section of each of the plurality of ribs along the longitudinal axis of the sole plate defines a rib cross sectional shape. In one embodiment, the rib cross sectional shape of each of the plurality of ribs is substantially identical to the groove cross sectional shape of each of the plurality of grooves. In an exemplary embodiment, the rib cross sectional shape of each of the plurality of ribs and the groove cross sectional shape of each of the plurality of grooves is substantially rectangular.

Each of the plurality of ribs nests within a respective one of the plurality of grooves, such that one of the plurality of ribs substantially fills one of the plurality of grooves.

In one embodiment, each of the plurality of ribs is a friction fit with a different respective one of the plurality of grooves to secure the flex control insert relative to the sole plate.

The sole plate includes a thickness between the foot-facing surface and the ground-facing surface. Each of the plurality of grooves includes a bottom surface spaced from the foot-facing surface by a groove depth. In one exemplary embodiment, the groove depth is less than the thickness of the sole plate.

The flex control insert is a substantially non-compressible material. In one exemplary embodiment, the flex control insert is a rubber material, and the sole plate is one of either a copolymer polypropylene material, or a nylon material.

Each of the plurality of ribs, which is disposed within a different respective one of the plurality of grooves, provides a resistance against dorsiflexion of the sole plate in a direction along the longitudinal axis. Dorsiflexion of the sole plate along the longitudinal axis drives or pinches the grooves of the sole plate into their respective rib disposed therein. The ribs within their respective grooves, being substantially non-compressible, maintain their volume and resist movement of the grooves, thereby increasing the bending stiffness of the sole plate. As the sole plate is bent further in dorsiflexion, the ribs of the flex control insert provide a higher level of resistance, providing a non-linear increase in the bending stiffness of the sole plate with increased angles of dorsiflexion. Accordingly, the bending stiffness of the sole plate increases as dorsiflexion of the sole plate along the longitudinal axis increases.

In one exemplary embodiment, the ribs disposed within their respective one of the plurality of grooves are operable to provide a maximum bending stiffness of the sole plate along the longitudinal axis at a dorsiflexion angle of approximately fifty-six degrees.

The features and advantages of the present teachings are readily apparent from the following detailed description of modes for carrying out the teachings when taken in connection with the accompanying Figures.

The terms "A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Referring to the Figures, wherein like numerals indicate like parts throughout the several views, an article of footwear is generally shown at 20 in FIG. 1. Referring to FIG. 1, the article of footwear 20 includes an upper 22 and a sole structure 24. The sole structure 24 may also be referred to as a sole assembly, especially when a corresponding sole plate 26 is assembled with other sole components in the sole structure 24, such as with other sole layers.

The upper 22 may include, for example, any conventional upper 22 suitable to support, receive and retain a foot of a wearer. The upper 22 includes a void configured to accommodate insertion of the wearer's foot, and to effectively secure the foot within the footwear 20 relative to an upper surface of the sole structure 24, or to otherwise unite the foot and the footwear 20. The upper 22 typically includes one or more components suitable to further secure the user's foot proximate to the sole structure 24, such as but not limited, to a lace, a plurality of lace-receiving elements, and a tongue, as will be recognized by those skilled in the art. The upper 22 may be formed of one or more layers, including for example, one or more of a weather-resistant layer, a wear-resistant outer layer, a cushioning layer, and/or a lining layer. Although the above described configuration for the upper 22 provides an example of an upper 22 that may be used in connection with the embodiments of the sole structure 24 described herein, a variety of other conventional or nonconventional configurations for the upper 22 may also be utilized.

The sole structure 24 includes the sole plate 26 described herein, and has a nonlinear bending stiffness that increases with increasing flexion of a forefoot portion 36 of the sole plate 26 in a longitudinal direction of the sole plate 26. As further described herein, the sole structure 24, and more specifically the sole plate 26, has at least one stiffness enhancing feature. The stiffness enhancing feature provides an increasing rate of change in the bending stiffness of the sole structure 24 as an angle of flexion in the sole structure 24 in the longitudinal direction increases. More particularly, the sole structure 24 has a bending stiffness that is nonlinear, and increases as the angle of flexion of the sole plate 26 increases in the longitudinal direction along a longitudinal axis 28 of the sole plate 26.

The sole structure 24 of the article of footwear 20 extends between the foot and the ground to, for example, attenuate ground reaction forces to cushion the foot, provide traction, enhance stability, and influence the motion of the foot. When the sole structure 24 is coupled to the upper 22, the sole structure 24 and the upper 22 can flex in cooperation with each other.

The sole structure 24 may be a unitary structure with a single layer, or the sole structure 24 may include multiple layers. For example and as shown in FIG. 1, a non-limiting exemplary multiple layer sole structure 24 may include three layers, referred to as an insole 30, the sole plate 26, and an outsole 32 for descriptive convenience herein. The insole 30 may include a thin, comfort-enhancing member located adjacent to the foot. The sole plate 26 forms the middle layer of the sole structure 24 between the insole 30 and the outsole 32, and may serve a variety of purposes that may include controlling foot motions. The outsole 32 may include one or more ground-engaging elements 34, and is usually fashioned form a durable, wear resistant material. The ground engaging elements 34 of the outsole 32 may include texturing or other traction features or elements, such as cleats, configured to improve traction with one or more types of ground surfaces (e.g., natural grass, artificial turn, asphalt pavement, dirt, etc.). Examples of such wear resistant materials may include, but are not limited to, nylon, thermoplastic polyurethane, carbon fiber, and others, as would be recognized by a person skilled in the art. In the exemplary embodiment shown in the Figures, the sole plate 26 is an inner sole plate 26 of the sole structure 24. The inner sole plate 26 may also be referred to as an insole plate, an inner board plate, an inner board, or an insole board. In other embodiments, the sole plate 26 may be a midsole plate 26 or a uni-sole plate 26. Optionally, a lining layer, or other sole layers of the article of footwear 20 may overlay a foot-facing surface 46 of the sole plate 26 and be positioned between the foot and the foot-facing surface 46. Other sole layers may underlay a ground-facing surface 48 of the sole plate 26, and be positioned between the sole plate 26 and the outsole 32.

Figure 2:
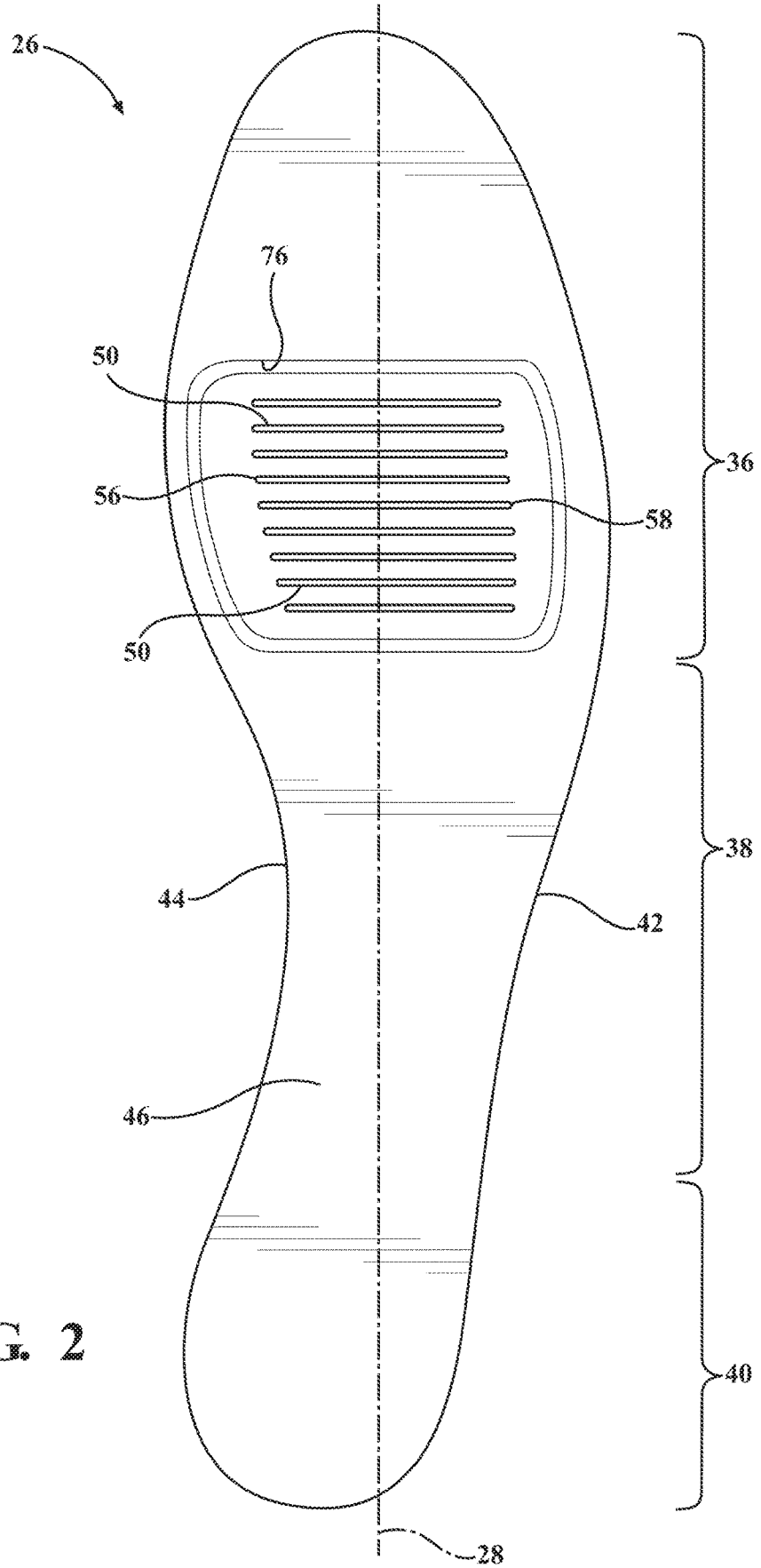
FIG. 2 is a schematic plan view of a sole plate of the sole structure viewed from a foot-facing surface of the sole plate.

Referring to FIG. 2, the sole plate 26 may be a full-length, unitary sole plate 26 that has a forefoot portion 36, a midfoot portion 38, and a heel portion 40. Alternatively, the sole plate 26 may include a partial length sole plate 26 that includes only the forefoot portion 36 and the midfoot portion 38, and/or portions thereof, and which is attached to other components of the sole structure 24. The heel portion 40 generally includes portions of the sole plate 26 corresponding with rear portions of a human foot, including the calcaneus bone, when the human foot is supported on the sole structure 24 and is a size corresponding with the sole structure 24. The forefoot portion 36 generally includes portions of the sole plate 26 corresponding with the toes and the joints connecting the metatarsals with the phalanges of the human foot. The midfoot portion 38 generally includes portions of the sole plate 26 corresponding with an arch area of the human foot, including the navicular joint. As best shown in FIG. 2, the sole plate 26 includes the longitudinal axis 28, which extends along a longitudinal midline of the sole structure 24, between the heel portion 40 and the forefoot portion 36 of the sole structure 24.

As used herein and as best shown in FIG. 2, a lateral side of a component for the article of footwear 20, including a lateral edge 42 of the sole plate 26, is a side that corresponds with an outside area of the human foot (i.e., the side closer to the fifth toe of the wearer). The fifth toe is commonly referred to as the little toe. A medial side of a component for an article of footwear 20, including a medial edge 44 of the sole plate 26, is the side that corresponds with an inside area of the human foot (i.e., the side closer to the hallux of the foot of the wearer). The hallux is commonly referred to as the big toe.

The term "longitudinal," as used herein, refers to a direction extending along a length of the sole structure 24, i.e., extending from the forefoot portion 36 to the heel portion 40 of the sole structure 24. The term "transverse" as used herein, refers to a direction extending along a width of the sole structure 24, i.e., extending from the medial edge 44 of the sole plate 26 to the lateral edge 42 of the sole plate 26. The term "forward" is used to refer to the general direction moving from the heel portion 40 toward the forefoot portion 36, and the term "rearward" is used to refer to the opposite direction, i.e., the direction moving from the forefoot portion 36 toward the heel portion 40. The term "anterior" is used to refer to a front or forward component or portion of a component. The term "posterior" is used to refer to a rear or rearward component of a portion of a component. The term "plate", such as the sole plate 26, refers to a generally horizontally-disposed member that is generally used to provide support structure and may or may not be used to provide cushioning. As used in this description and the accompanying claims, the phrase "bend stiffness" or "bending stiffness" generally means a resistance to flexion of the sole structure 24 exhibited by a material's composition, structure, assembly of two or more components or a combination thereof, according to the disclosed embodiments and their equivalents.

As noted above and with reference to FIG. 1, the sole plate 26 includes the foot-facing surface 46 and the ground-facing surface 48. The foot-facing surface 46 and the ground-facing surface 48 are disposed opposite of each other. A foot may be supported by the foot-facing surface 46, with the foot disposed above the foot-facing surface 46. The foot-facing surface 46 may be referred to as an upper surface of the sole plate 26. The ground-facing surface 48 may be referred to as a lower surface of the sole plate 26.

The sole plate 26 is referred to as a plate, but is not necessarily flat and need not be a single component but instead can be multiple interconnected components. For example, both the foot-facing surface 46 and the opposite ground-facing surface 48 may be pre-formed with some amount of curvature and variations in thickness when molded or otherwise formed in order to provide a shaped footbed and/or increased thickness for reinforcement in desired areas. For example, the sole plate 26 could have a curved or contoured geometry that may be similar to the lower contours of a foot. For example, the sole plate 26 may have a contoured periphery that slopes upward toward any overlaying layers, such as a component or the upper 22.

The sole plate 26 may be entirely of a single, uniform material, or may have different portions comprising different materials. For example, a first material of the forefoot portion 36 can be selected to achieve, in conjunction with other features and components of the sole structure 24 discussed herein, the desired bending stiffness in the forefoot portion 36, while a second material of the midfoot portion 38 and the heel portion 40 can be a different material that has little effect on the bending stiffness of the forefoot portion 36. By way of non-limiting example, the second portion can be over-molded onto or co-injection molded with the first portion. Example materials for the sole plate 26 include durable, wear resistant materials such as but not limited to nylon, thermoplastic polyurethane, or carbon fiber.

Various materials may be used to manufacture the sole plate 26 discussed herein. For example, a thermoplastic elastomer, such as thermoplastic polyurethane (TPU), a glass composite, a nylon including glass-filled nylons, a spring steel, carbon fiber, ceramic or a foam or rubber material (such as but not limited to a foam or rubber with a Shore A Durometer hardness of about 50-70 (using ASTM D2240-05(2010) standard test method) or an Asker C hardness of 65-85 (using hardness test JIS K6767 (1976) may be used for the sole plate 26.

Figure 4:
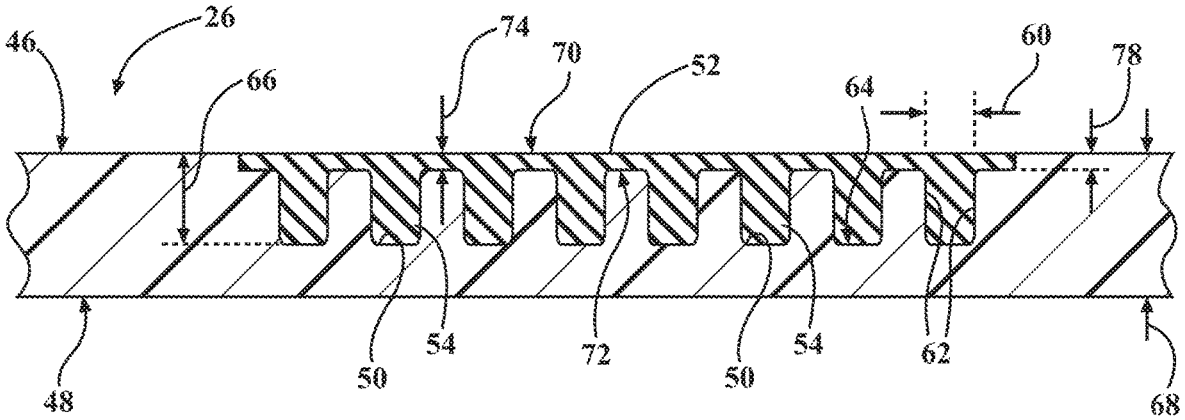
FIG. 4 is a schematic partial cross sectional view of the sole structure in an un-flexed position.
Figure 5:
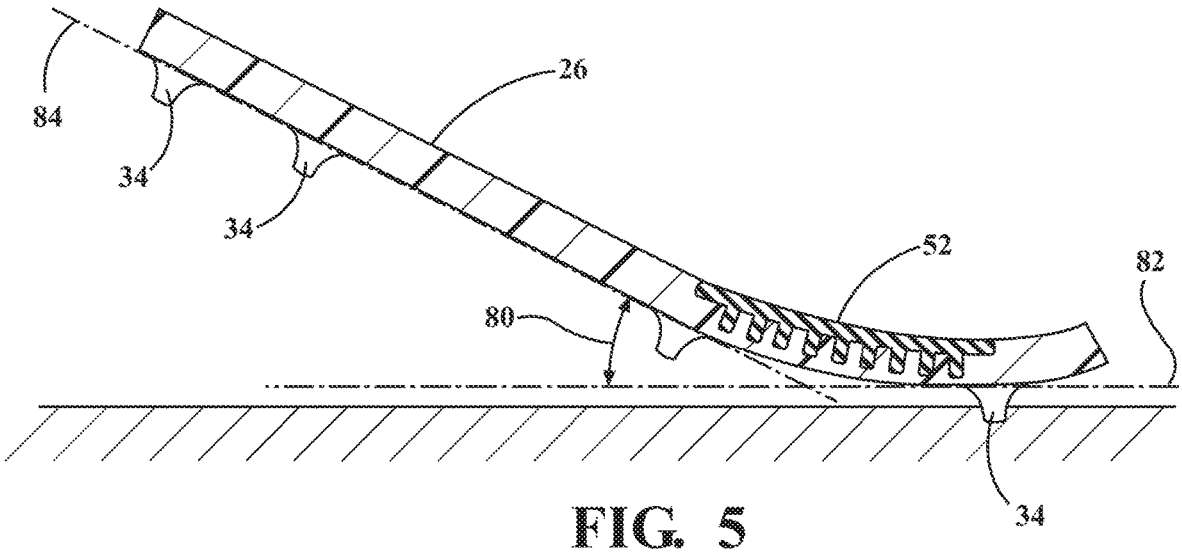
FIG. 5 is a schematic cross sectional view of the sole structure in a flexed position.

As noted above, the sole plate 26 includes a stiffness enhancing feature that nonlinearly increases the bending stiffness of the sole plate 26 as the dorsiflexion of the sole plate 26 increases in the longitudinal direction of the sole plate 26 along the longitudinal axis 28 of the sole plate 26. Referring to FIG. 4, the stiffness enhancing feature includes a plurality of grooves 50 formed into the foot-facing surface 46 of the sole plate 26, cooperating with a flex control insert 52 having a plurality of ribs 54. One of the ribs 54 of the flex control insert 52 is positioned within a respective one of the grooves 50 of the sole plate 26. Referring to FIG. 5, flexion of the sole plate 26 in the forefoot portion 36 of the sole plate 26, along the longitudinal axis 28, causes sidewalls of the grooves 50 to drive into or compress the ribs 54 of the flex control insert 52 disposed within each respective groove 50. The ribs 54 maintain their respective volume and resist compression by the grooves 50. Increased flexion of the sole plate 26 produces and increased resistance from the ribs 54, thereby providing a non-linear response to flexion of the sole plate 26.

Referring to FIGS. 2 and 4, the plurality of grooves 50 extend transversely across the sole plate 26 relative to the longitudinal axis 28 of the sole plate 26, in the forefoot region of the foot-facing surface 46. Generally, the overall longitudinal location of the grooves 50 and the flex control insert 52 along the longitudinal axis 28 of the sole plate 26 is selected to be sufficient to accommodate a range of positions of the wearer's metatarsophalangeal joints based on population averages for the particular size of footwear 20.

Each groove 50 is generally straight, and the grooves 50 are generally parallel with one another. The grooves 50 may be formed, for example, during molding of the sole plate 26. Each groove 50 has a medial end 56 and a lateral end 58 (indicated with reference numbers on only one of the grooves 50 in FIG. 2), with the medial end 56 closer to the medial edge 44 of the sole plate 26, and the lateral end 58 closer to the lateral edge 42 of the sole plate 26. The lateral end 58 is slightly rearward or posterior of the medial end 56 so that the grooves 50 fall under and generally follow the anatomy of the metatarsophalangeal joints of a foot. The grooves 50 extend generally transversely in the sole plate 26 between the medial edge 44 and the lateral edge 42.

Each groove 50 has a predetermined width 60 at the foot-facing surface 46. Although not specifically shown, the foot-facing surface 46 may be chamfered or rounded at each groove 50 to reduce the possibility of plastic deformation as could occur with sharp corner contact when compressive forces are applied across the grooves 50. If chamfered or rounded in this manner, then the width 60 of each groove 50 would be measured between adjacent side walls 62 of the groove 50 at the start of any chamfer (i.e., at the point on the side walls 62 of the groove 50 just below any chamfered or rounded edge). Each of the grooves 50 may be narrower at a bottom surface 64 of the groove 50 (i.e., at a root or base of the groove 50 just above a base portion of the sole plate 26) than at the width 60 of the groove 50. Although each groove 50 is depicted as having the same width 60, different ones of the grooves 50 could have different widths 60. Each of the grooves 50 has a groove depth 66, measured from the foot-facing surface 46 to the bottom surface 64 of the respective groove 50. Although each groove 50 is depicted as having the same groove depth 66, different ones of the grooves 50 could have different groove depths 66.

As shown in FIG. 4, the sole plate 26 includes a thickness 68 that is measured between the foot-facing surface 46 and the ground-facing surface 48. In the exemplary embodiment shown in the figures, the groove depth 66 is less than the thickness 68 of the sole plate 26. However, in other embodiments, the grooves 50 may extend completely through the sole plate 26, such that the groove depth 66 is substantially equal to the thickness 68 of the sole plate 26.

Figure 3:
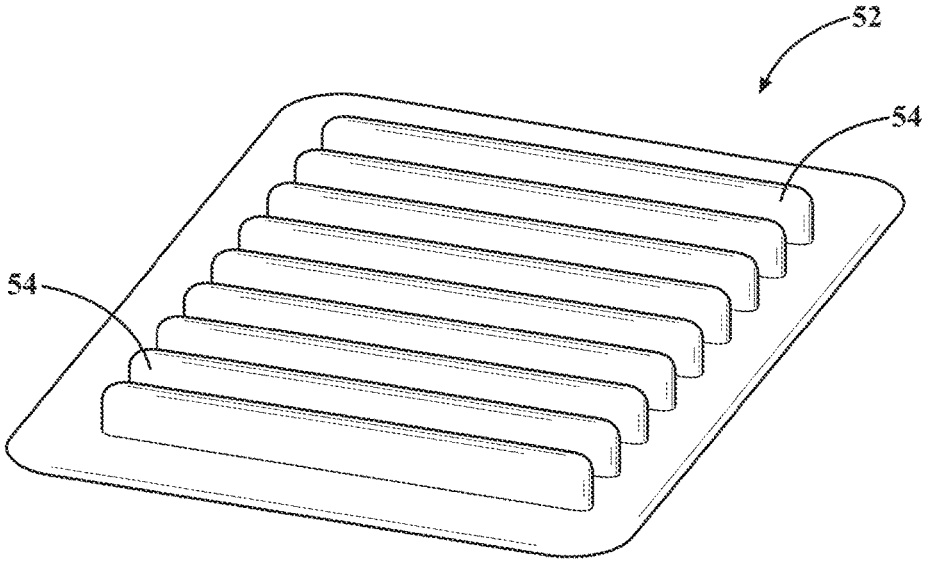
FIG. 3 is a schematic perspective view of a flex control insert of the sole structure.

Referring to FIGS. 3 and 4, the flex control insert 52 is positioned adjacent the foot-facing surface 46 of the sole plate 26. The flex control insert 52 includes an upper surface 70 and a lower surface 72 disposed opposite the upper surface 70. The plurality of ribs 54 of the flex control insert 52 protrude or extend outward from the lower surface 72 of the flex control insert 52. The ribs 54 extend transversely relative to the longitudinal axis 28, across the sole plate 26. Each one of the plurality of ribs 54 is disposed within a different respective one of the plurality of grooves 50. Accordingly, each of the plurality of ribs 54 nests within a respective one of the plurality of grooves 50, such that one of the plurality of ribs 54 substantially fills one of the plurality of grooves 50.

The ribs 54 extend generally transversely and overlay the grooves 50. Each of the ribs 54 is coincident with a different respective one of the grooves 50. Accordingly, the number of ribs 54 is the same as the number of grooves 50. The length of each respective groove 50 extends from its respective medial end 56 to its respective lateral end 58. In the embodiment shown, a center line of each respective groove 50 extends along its length, is generally parallel with and may fall in the same vertical plane as the center axis of the respective rib 54 disposed within the groove 50.

In some embodiments, the flex control insert 52 includes and may be manufactured from a material having a compressibility that is generally equal to or greater than a compressibility of the sole plate 26. In some embodiments, the flex control insert 52 may include and be manufactured from a material that is considered to be a substantially non-compressible material. For example, the flex control insert 52 may include and be manufactured from a rubber material, a nylon material, a metal material, a carbon material, etc. The flex control insert 52 is removable and re-insertable into and out of the sole plate 26, such that different inserts having different bending/compression properties, may be interchangeably used with the sole plate 26. In so doing, the bending stiffness of the sole plate 26 may be customized for a particular activity or a particular wearer by changing the flex control insert 52. For example, the flex control insert 52 may include a first flex control insert formed from a first material having a first compressibility, and a second flex control insert formed from a second material having a second compressibility that is different from the first compressibility. Although not specifically shown in the Figures, it should be appreciated that the first flex control insert and the second flex control insert would be formed to include the same shape as the flex control insert 52 shown in the Figures, the only difference being in the material characteristics and the relative compressibility that each provide. The first flex control insert and the second flex control insert may be configured to be alternatingly or interchangeably received within the plurality of grooves of the sole plate 26, such that the sole structure exhibits a first non-linear bending stiffness with the first flex control insert disposed within the plurality of grooves, and a second or different non-linear bending stiffness with the second flex control insert disposed with in the plurality of grooves.

In an exemplary embodiment, each of the plurality of ribs 54 is a friction or press fit with a different respective one of the plurality of grooves 50 to secure the flex control insert 52 relative to the sole plate 26. A cross section of each of the plurality of grooves 50 along the longitudinal axis 28 of the sole plate 26 defines a groove 50 cross sectional shape. A cross section of each of the plurality of ribs 54 along the longitudinal axis 28 of the sole plate 26 defines a rib 54 cross sectional shape. The rib 54 cross sectional shape of each of the plurality of ribs 54 is substantially identical to the groove 50 cross sectional shape of each of the plurality of grooves 50, thereby providing the friction or press fit between corresponding pairs of ribs 54 and grooves 50.

In the exemplary embodiment best shown in FIG. 4, the rib 54 cross sectional shape of each of the plurality of ribs 54 and the groove 50 cross sectional shape of each of the plurality of grooves 50 is substantially rectangular. However, it should be appreciated that the rib 54 cross sectional shape and the groove 50 cross sectional shape may vary from the exemplary embodiment shown in the Figures, and may alternatively include a triangular cross sectional shape, a semi-circular cross sectional shape, or a polygonal cross sectional shape.

In various embodiments, different ones of the grooves 50 could have different groove depths 66, widths 60, shapes, and or spacing from one another, with the respective ribs 54 disposed within the respective groove 50 being similarly sized and shaped. Accordingly, each mating pair of grooves 50 and ribs 54 may include a corresponding, length, depth, and cross sectional shape. For example, grooves 50 and their respective ribs 54 toward a middle of the plurality of grooves 50 in the longitudinal direction could be wider than the grooves 50 and respective ribs 54 toward the anterior and posterior ends of the plurality of grooves 50. Generally, the overall length of the plurality of grooves 50 along the longitudinal axis 28 (i.e., from the anterior end to the posterior end of the plurality of grooves 50) is selected to be sufficient to accommodate a range of positions of a wearer's metatarsophalangeal joints based on population averages for the particular size of footwear 20.

Referring to FIG. 4, the flex control insert 52 includes a thickness 74 measured between the upper surface 70 and the lower surface 72 of the flex control insert 52. The sole plate 26 may include a recess 76 formed into the foot-facing surface 46, which is generally disposed about a periphery of the plurality of grooves 50 in the sole plate 26. The recess 76 in the foot-facing surface 46 of the sole plate 26 includes a depth 78 measured from the foot-facing surface 46 that is substantially equal to the thickness 74 of the flex control insert 52, so that the upper surface 70 of the flex control insert 52 is substantially aligned with and co-planar with the foot-facing surface 46 of the sole plate 26. The plurality of grooves 50 extends across more than half of the width of the sole plate 26.

As noted above, each of the plurality of ribs 54 disposed within a different respective one of the plurality of grooves 50 provides a resistance against dorsiflexion of the sole plate 26 in the longitudinal direction along the longitudinal axis 28 of the sole plate 26. The bending stiffness of the sole plate 26 increases as dorsiflexion of the sole plate 26 along the longitudinal axis 28 increases. Accordingly, referring to FIG. 5, as a flex angle 80 of the sole plate 26 increases, the bending stiffness of the sole plate 26 also increases. The flex angle 80 is defined as the angle formed at the intersection between a first axis 82 and a second axis 84. The first axis 82 generally extends along the longitudinal axis 28 of the sole plate 26 at the ground-facing surface 48 of the sole plate 26 anterior to the flex control insert 52, i.e., in front of the portions or sections of the sole plate 26 that flex or bend during dorsiflexion of the sole plate 26. The longitudinal axis 28 of the sole plate 26 may also be referred to as a longitudinal midline of the sole plate 26. The second axis 84 generally extends along the longitudinal axis 28 of the sole plate 26 at the ground-facing surface 48 of the sole plate 26 posterior to the flex control insert 52, i.e., behind the portions or sections of the sole plate 26 that flex or bend during dorsiflexion of the sole plate 26. The sole plate 26 is configured so that the intersection of the first axis 82 and the second axis 84 is approximately centered both longitudinally and transversely below the metatarsophalangeal joints of a foot supported on the foot-facing surface 46 of the sole plate 26.

Figure 6:
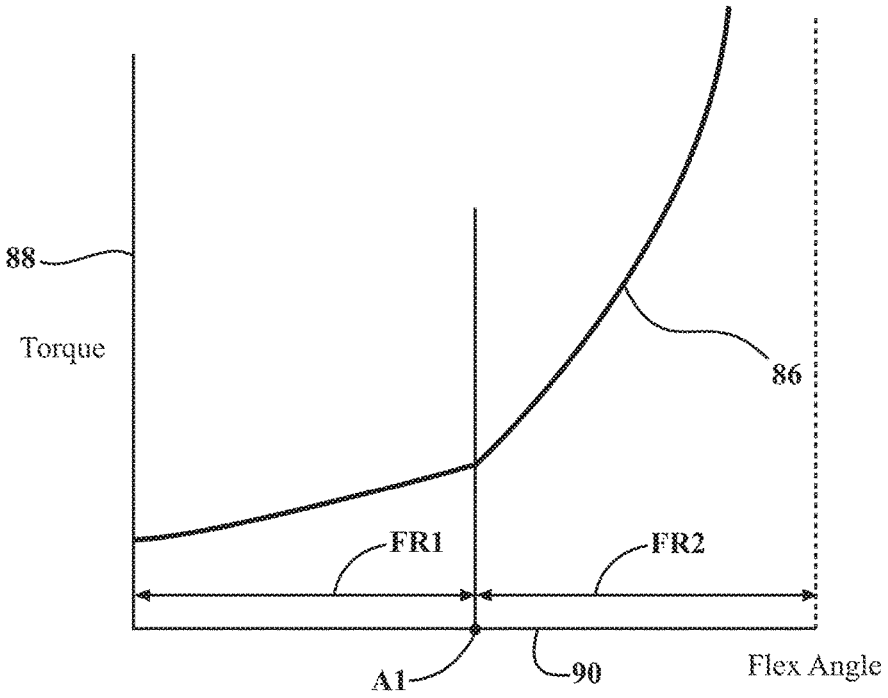
FIG. 6 is a plot of torque versus flexion angle for the sole structure.

As a wearer's foot flexes by lifting the heel portion 40 away from a ground surface, while maintaining contact with the ground surface at the forefoot portion 36, it places torque on the sole structure 24 and causes the sole plate 26 to flex through the forefoot portion 36. Referring to FIG. 6, an example plot indicating the bending stiffness (slope of the line) for the sole structure 24 is generally shown at 86. Torque (in Newton-meters) is shown on a vertical axis 88, and the flex angle 80 (in degrees) is shown on a horizontal axis 90. As is understood by those skilled in the art, the torque results from a force applied at a distance from a bending axis located in the proximity of the metatarsophalangeal joints, as occurs when a wearer flexes the sole structure 24. The bending stiffness changes (increases) as the flex angle 80 changes (increases). Additionally, the rate at which the bending stiffness increases as the torque increases also changes, with the rate at which the bending stiffness increases increasing as the flex angle 80 and torque of the sole plate 26 increases. Accordingly, the bending stiffness of the sole plate 26 may be considered non-linear.

The sole plate 26 may be constructed in such a manner so that the bending stiffness exhibits a distinct change at a predetermined flex angle, generally denoted by flex angle A1 in FIG. 6. The flex angle A1 generally defines a first flexion range FR1 occurring at flex angles less than the flex angle A1, and a second flexion range FR2 occurring at flex angles greater than the flex angle A1. For example, the bending stiffness of the sole plate 26 in the first flexion range FR1 may primarily derive from the bending stiffness of the sole plate 26 alone, whereas the bending stiffness of the sole plate 26 in the second flexion range FR2 may derive from a combination of the bending stiffness of the sole plate 26 in combination with the bending stiffness provided by the interaction between the ribs 54 and grooves 50 of the flex control insert 52. While the graph of FIG. 6 shows a continuous or smooth change in the bending stiffness throughout and between both the first flexion range FR1 and the second flexion range FR2, it should be appreciated that the bending stiffness between the first flexion range FR1 and the second flexion range FR2 may differ dramatically, and may not be a smooth transition. For example, the bending stiffness in the first flexion range FR1 may change only slightly, whereas the bending stiffness in the second flexion range FR2 may change very greatly. Furthermore, the flex angle A1 may occur at a very small angle, such that the majority of the graph shown in FIG. 6 would be occupied by the second flexion region FR2. In some embodiments, the sole plate 26 may be constructed so that the first flexion range FR1 is nearly non-existent.

The change or departure from the gradually and smoothly inclining curve characteristic of the first portion of the flexion range FR1 may be referred to herein as a "non-linear" increase in bend stiffness, and would manifest as either or both of a stepwise increase in bending stiffness and/or a change in the rate of increase in the bending stiffness. The change in rate can be either abrupt, or it can manifest over a short range of increase in the bend angle of the sole structure 24. In either case, a mathematical function describing a bending stiffness in the second portion of the flexion range FR2 will differ from a mathematical function describing bending stiffness in the first portion of the flexion range FR1. The bending stiffness in the first range of flexion FR1 may be constant (thus the plot would have a linear slope) or substantially linear or may increase gradually (which would show a change in slope in FR1). The bending stiffness in the second range of flexion FR2 may be linear or non-linear, but will depart from the bending stiffness of the first range of flexion FR1 at the first predetermined flex angle A1, either markedly or gradually (such as over a range of several degrees) at the first predetermined flex angle A1.

By way of non-limiting example, the first predetermined flex angle A1 may be from about 30 degrees to about 65 degrees. In one exemplary embodiment, the first predetermined flex angle A1 is found in the range of between about 30 degrees and about 60 degrees, with a typical value of about 55 degrees. In another exemplary embodiment, the first predetermined flex angle A1 is found in the range of between about 15 degrees and about 30 degrees, with a typical value of about 25 degrees. In another example, the first predetermined flex angle A1 is found in the range of between about 20 degrees and about 40 degrees, with a typical value of about 30 degrees.

In some embodiments, the interaction between the plurality of ribs 54 and the plurality of grooves 50 is operable to provide a maximum bending stiffness of the sole plate 26, along the longitudinal axis 28, when a dorsiflexion of the sole plate 26, i.e., the flex angle 80, is between 35 degrees and 65 degrees. For example, the maximum bending stiffness may be achieved when the flex angle 80 of the sole plate 26 is approximately equal to 56°.

As will be understood by those skilled in the art, when the sole plate 26 flexes or bends, the foot-facing surface 46 of the sole plate 26 is placed in compression. This operates to compress the ribs 54 disposed within their respective grooves 50. Because the ribs 54 are generally non-compressible, the ribs 54 resist compression and maintain their volume, thereby resisting the flexion of the sole plate 26, which in turn increases the bending stiffness of the sole plate 26 beyond that provided by the sole plate 26 itself. The flex control insert 52 may be replaced with a different insert having different compression characteristics to modify the bending response of the sole plate 26.

The detailed description and the Figures are supportive and descriptive of the present teachings, but the scope of the present teachings is defined solely by the appended claims. While several modes for carrying out the many aspects of the present teachings have been described in detail, those familiar with the art to which these teachings relate will recognize various alternative aspects for practicing the present teachings that are within the scope of the appended claims.

The invention claimed is:

1. A sole structure for an article of footwear, the sole structure comprising:

a sole plate having a longitudinal axis, and including a foot-facing surface with a forefoot region, and a ground-facing surface opposite from the foot-facing surface;

wherein the sole plate includes a plurality of discrete grooves formed into the foot-facing surface in the forefoot region and extending transversely relative to the longitudinal axis across more than half of a width of the sole plate;

wherein the sole plate includes a recess formed into the foot-facing surface and disposed entirely around a periphery of the plurality of discrete grooves, the recess having a depth with the plurality of discrete grooves extending into the sole plate from a bottom of the recess;

a first flex control insert formed of a material having a first compressibility and including an upper surface and a lower surface opposite the upper surface, wherein the first flex control insert has a thickness from the upper surface to the lower surface equal to the depth of the recess so that the upper surface of the first flex control insert is flush with the foot-facing surface of the sole plate;

wherein the first flex control insert is one-piece including a plurality of ribs protruding from the lower surface of the first flex control insert, with each one of the plurality of ribs received within a different respective one of the plurality of discrete grooves to extend transversely relative to the longitudinal axis of the sole plate;

a second flex control insert formed of a material having a second compressibility different from the first compressibility, wherein ribs of the first flex control insert and the second flex control insert are removable from and reinsertable in the sole plate at the plurality of discrete grooves for adjusting a bending stiffness of the sole structure; and an outsole underlying the ground-facing surface of the sole plate and defining a ground-engaging surface of the sole structure, the outsole spacing the sole plate apart from the ground-engaging surface of the sole structure;

wherein the sole plate includes a thickness between the foot-facing surface and the ground-facing surface, the sole plate defines a bottom surface of each of the plurality of discrete grooves, the bottom surface spaced from the foot-facing surface by a groove depth, and the groove depth is less than the thickness of the sole plate.

2. The sole structure set forth in claim 1, wherein a cross-section of each of the plurality of discrete grooves along the longitudinal axis of the sole plate defines a groove cross-sectional shape, and a cross-section of each of the plurality of ribs of the first flex control insert along the longitudinal axis of the sole plate defines a rib cross-sectional shape.

3. The sole structure set forth in claim 2, wherein the rib cross-sectional shape of each of the plurality of ribs of the first flex control insert corresponds to the groove cross-sectional shape of each of the plurality of discrete grooves.

4. The sole structure set forth in claim 2, wherein the rib cross-sectional shape of each of the plurality of ribs of the first flex control insert and the groove cross-sectional shape of each of the plurality of discrete grooves is rectangular.

5. The sole structure set forth in claim 1, wherein one of the plurality of ribs of the first flex control insert substantially fills one of the plurality of discrete grooves.

6. The sole structure set forth in claim 1, wherein each of the plurality of ribs of the first flex control insert provides a friction fit within a different respective one of the plurality of discrete grooves and secures the first flex control insert relative to the sole plate.

7. The sole structure set forth in claim 1, wherein the first compressibility of the first flex control insert is equal to or greater than a compressibility of the sole plate.

8. The sole structure set forth in claim 1, wherein the material of the first flex control insert comprises a non-compressible material.

9. The sole structure set forth in claim 1, wherein the first flex control insert comprises a rubber material.

10. The sole structure set forth in claim 1, wherein the sole plate is one of either a copolymer polypropylene material or a nylon material.

11. The sole structure set forth in claim 1, wherein each one of the plurality of ribs of the first flex control insert disposed within the different respective one of the plurality of discrete grooves provides a resistance against dorsiflexion in a direction along the longitudinal axis in the forefoot region of the sole plate.

12. A sole structure for an article of footwear, the sole structure comprising:

a sole plate extending along a longitudinal axis, and including a foot-facing surface with a forefoot region, and a ground-facing surface opposite from the foot-facing surface, wherein the sole plate includes a continuous recess formed into the foot-facing surface only in the forefoot region and extending only partway transversely across the sole plate, the continuous recess having a depth;

the sole plate including a sequentially arranged plurality of discrete grooves formed into the forefoot region of the foot-facing surface and extending into the sole plate from a bottom of the continuous recess, the continuous recess disposed entirely around a collective periphery of the plurality of discrete grooves, and each groove being linear and extending across more than half of a width of the sole plate;

an outsole underlying the ground-facing surface of the sole plate and defining a ground-engaging surface of the sole structure, the outsole spacing the sole plate apart from the ground-engaging surface of the sole structure; and a one-piece flex control insert including an upper surface and a lower surface opposite the upper surface, and including a sequentially arranged plurality of ribs protruding from the lower surface of the one-piece flex control insert, with each of the plurality of ribs disposed within a different respective groove of the plurality of discrete grooves and entirely above a bottom surface of the different respective groove, and the upper surface flush with the foot-facing surface of the sole plate;

wherein the sole plate includes a thickness between the foot-facing surface and the ground-facing surface, the sole plate defines a bottom surface of each of the plurality of discrete grooves, the bottom surface spaced from the foot-facing surface by a groove depth, and the groove depth is less than the thickness of the sole plate;

wherein the plurality of ribs respectively disposed within the plurality of discrete grooves provides a resistance against dorsiflexion of the forefoot region of the sole plate in a direction along the longitudinal axis, the one-piece flex control insert removable from and reinsertable in the sole plate; and wherein the one-piece flex control insert is a non-compressible material.

13. The sole structure set forth in claim 12, wherein the sole plate is one of either a copolymer polypropylene material exhibiting a compressibility, or a nylon material exhibiting a compressibility.

14. The sole structure set forth in claim 12, wherein:

a cross-section of each of the plurality of discrete grooves along the longitudinal axis of the sole plate defines a groove cross-sectional shape;

a cross-section of each of the plurality of ribs along the longitudinal axis of the sole plate defines a rib cross-sectional shape; and the rib cross-sectional shape of each of the plurality of ribs corresponds to the groove cross-sectional shape of each of the plurality of discrete grooves, with each of the plurality of ribs nested within a respective one of the plurality of discrete grooves and retaining the one-piece flex control insert in position relative to the sole plate.

15. The sole structure set forth in claim 12, wherein the non-compressible material of the one-piece flex control insert comprises a rubber material.

* * * * *